United States Patent [19]

Price

[11] Patent Number: 4,985,008

[45] Date of Patent: Jan. 15, 1991

[54] WRESTLER CHARACTER FIGURE

[75] Inventor: Daniel W. Price, Chepachet, R.I.

[73] Assignee: Hasbro, Inc., Pawtucket, R.I.

[21] Appl. No.: 475,843

[22] Filed: Feb. 6, 1990

[51] Int. Cl.[5] ..... A63H 13/10; A63H 13/06; A63H 13/00

[52] U.S. Cl. ..... 446/308; 446/335; 446/354

[58] Field of Search ..... 446/308, 309, 310, 311, 446/312, 330, 333, 334, 335, 336, 352, 353, 354, 356, 365

[56] References Cited

U.S. PATENT DOCUMENTS

| | | | |
|---|---|---|---|
| 2,598,954 | 6/1952 | Wengel | 446/334 X |
| 2,766,849 | 10/1954 | Rudiger | 185/37 |
| 3,874,112 | 4/1975 | Sapkus et al. | 446/336 X |
| 4,085,540 | 4/1978 | Jernstrom et al. | 446/333 |
| 4,120,117 | 10/1978 | Terzian et al. | 446/308 |
| 4,578,045 | 3/1986 | Mayer et al. | 446/330 |
| 4,579,542 | 4/1986 | Mayer et al. | 446/330 |
| 4,605,382 | 8/1986 | Cook et al. | 446/333 D |

FOREIGN PATENT DOCUMENTS

| | | | |
|---|---|---|---|
| 0150283 | 8/1985 | European Pat. Off. | 446/330 |

*Primary Examiner*—Robert A. Hafer
*Assistant Examiner*—E. Neal Muir
*Attorney, Agent, or Firm*—Salter & Michaelson

[57] ABSTRACT

A wrestler character figure includes a main body portion which is receivable in free standing relation on a supporting surface, a pair of pivotally mounted arm portions on the main body portion, a pair of hand portions on the arm portions and a biasing assembly in the main body portion. The arm portions are pivotable between upwardly extending first positions and downwardly extending second positions, and the biasing assembly is operative for biasing the arm portions toward the downwardly extending second positions thereof. The hand portions are positioned on the arm portions so they face upwardly when the arm portions are in the upwardly extending first positions thereof. The wrestler character figure is operative by pivoting the arm portions to the upwardly extending first positions thereof, balancing an opponent wrestler character figure on the hand portions and then releasing the arm portions so that the opponent wrestler character figure is thrown to the floor.

1 Claim, 2 Drawing Sheets

WRESTLER CHARACTER FIGURE

BACKGROUND AND SUMMARY OF THE INVENTION

The instant invention relates to character figure toys and more particularly to a character figure toy which is adapted to perform a predetermined professional wrestling maneuver.

The sport of professional wrestling has been highly popular with fans of various age groups for many years. However, in recent years the sport of professional wrestling has enjoyed an increased level of popularity among children. In fact, it has been found that many children now follow the careers of various specific professional wrestling characters, and that they have also learned to identify certain specific wrestling maneuvers performed by wrestling characters. However, despite the popularity of the sport of professional wrestling the toy industry has heretofore generally failed to provide an effective toy character which is operative for performing one or more specific wrestling maneuvers which are commonly performed by professional wrestlers.

The instant invention provides a unique wrestler character figure toy which is adapted for use in a simulated professional wrestling toy environment. Specifically, the instant invention provides a wrestler character figure which is adapted for performing a wrestling maneuver which is similar to the overhead body slam maneuver commonly utilized by several well known professional wrestlers. Still more specifically, the wrestler character figure of the instant invention comprises a free standing main body member including a leg portion, a torso portion, and a head and neck portion, a first arm portion having a first hand portion thereon, and a second arm portion having a second hand portion thereon. The first and second arm portions are pivotally mounted on the torso portion, so that they are movable between upwardly extending first positions and downwardly extending second positions. The wrestler character figure further comprises means biasing the first and second arm portions toward the downwardly extending second positions thereof, and the biasing means is preferably operative for mechanically interconnecting the first and second arm portions for movement together between the respective first and second positions thereof. The first and second arm portions preferably extend substantially vertically upwardly from the torso portion when the arm portions are in the first positions thereof, and the hand portions are preferably disposed above the head and neck portion when the arm portions are in the first positions thereof. Further, the hand portions are preferably disposed in substantially horizontal upwardly facing positions when the arm portions are in the first positions thereof.

The wrestler character figure of the instant invention is operative for performing an overhead body slam maneuver by moving the first and second arm portions to the upwardly pivoted first positions thereof against the force of the biasing means and then balancing an opponent character figure on the upwardly facing first and second hand portions while the arm portions are manually held in the first positions thereof. When the arm portions are thereafter released, they are pivoted to the downwardly extending second positions thereof by the biasing means so that the opponent character figure is thrown downwardly to simulate an overhead body slam maneuver.

It has been found that the wrestler character figure of the instant invention has a significant level of appeal and that it can be effectively utilized in a simulated professional wrestling play environment. In this regard, it has been found that because the wrestler character figure of the instant invention is capable of performing a simulated overhead body slam type maneuver, it has a relatively high level of play value and it can be incorporated into an interesting and amusing professional wrestling play theme.

Devices representing the closest prior art to the subject invention of which the applicant is aware are disclosed in the Rudiger U.S. Pat. No. 2,766,849 and Mayer et al, U.S. Pat. No. 4,578,045. However, since these references fail to disclose or suggest an action figure character which is capable of performing a professional wrestling type overhead body slam maneuver, they are believed to be of only general interest with respect to the subject invention.

Accordingly, it is a primary object of the instant invention to provide an action figure character which is capable of performing a simulated professional wresting maneuver.

Another object of the instant invention is to provide a simulated toy wrestler character figure which is capable of performing an overhead body slam maneuver.

Another object of the instant invention is to provide an effective toy wrestler character figure which can be utilized in a simulated professional wrestling play theme.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
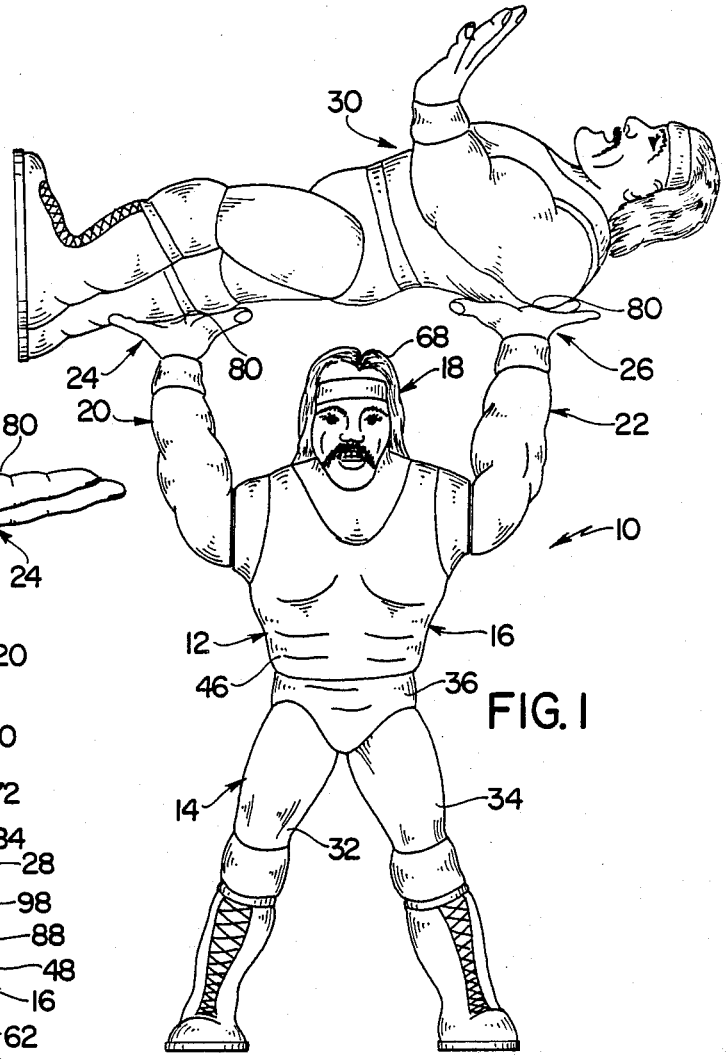
FIG. 1 is a front elevational view of the wrestler character figure of the instant invention with the arm portions thereof in the first positions thereof and an opponent character figure supported on the hand portions.

Referring now to the drawings, the wrestler character figure of the instant invention is illustrated and generally indicated at 10 in FIGS. 1–4. The wrestler character FIG. 10 comprises a main body member generally indicated at 12, including a leg portion generally indicated at 14, a torso portion generally indicated at 16, and a head and neck portion generally indicated at 18, and first and second arm portions generally indicated at 20 and 22, respectively, having first and second hand portions generally indicated at 24 and 26, respectively, thereon. The wrestler character FIG. 10 further comprises a biasing assembly generally indicated at 28 in FIGS. 2–4 which is operative for interconnecting the arm portions 20 and 22, and for biasing the first and second arm portions 20 and 22, respectively, for movement from the first or upwardly extending positions thereof illustrated in FIGS. 1 and 2 toward the second or downwardly extending positions thereof illustrated in FIG. 3. The wrestler character FIG. 10 is constructed so that when the first and second arm portions 20 and 22, respectively, are in the upwardly extending first positions thereof, the first and second hand portions 24 and 26, respectively, are operative for supporting an opponent character figure generally indicated at 30 so that the opponent character FIG. 30 is positioned above the head and neck portion 18 of the wrestler character FIG. 10. Accordingly, when the first and second arm portions 20 and 22, respectively, are pivoted downwardly to the second positions thereof by the biasing means 28, the opponent character FIG. 30 is thrown to the ground or floor by the wrestler character FIG. 10.

The leg portion 14 is preferably molded from a suitable plastic material, and it is formed so that it is receivable on a supporting surface for supporting the wrestler character FIG. 10 in free standing relation thereon, so that the wrestler character FIG. 10 is capable of supporting the opponent character FIG. 30 in the manner illustrated in FIG. 1. The leg portion 14 comprises first and second leg elements 32 and 34, respectively, and an abdomen section 36. The upper end of the abdomen section 36 is defined by a substantially flat, upwardly facing surface 38 and a mounting post generally indicated at 40 extends upwardly from the surface 38. The mounting post 40 has an enlarged upper end portion 42 and a pair of stop elements 44 extend outwardly from opposite sides of the enlarged upper end portion 42.

Figure 2:
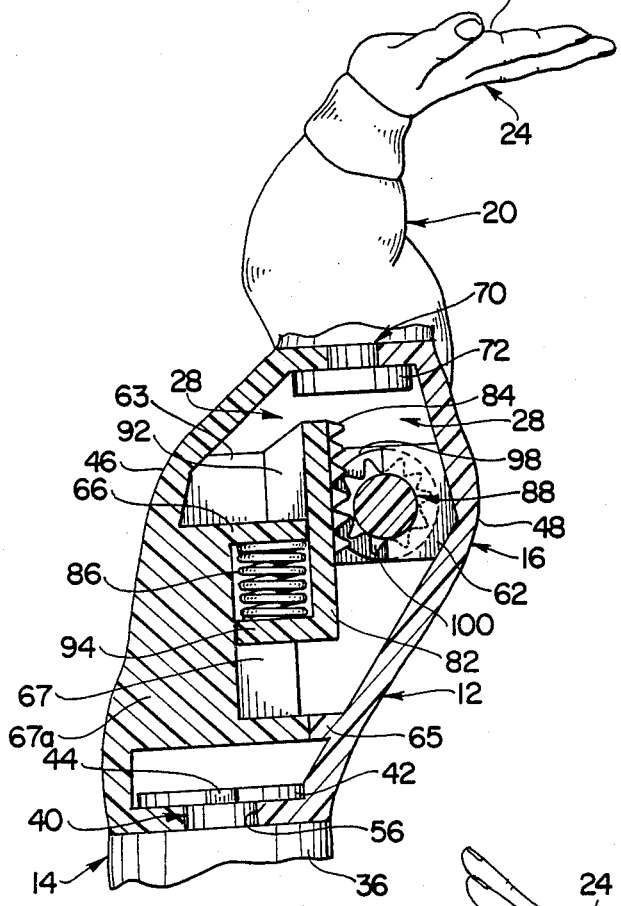
FIG. 2 is a fragmentary side sectional view thereof with the arm portions in the first positions thereof.
Figure 3:
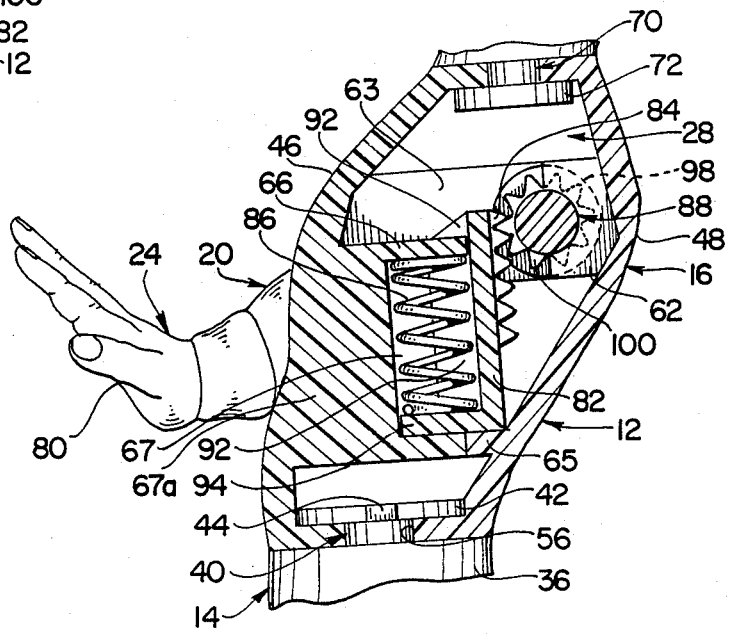
FIG. 3 is a similar side sectional view with the arm portions in the second positions thereof.
Figure 4:
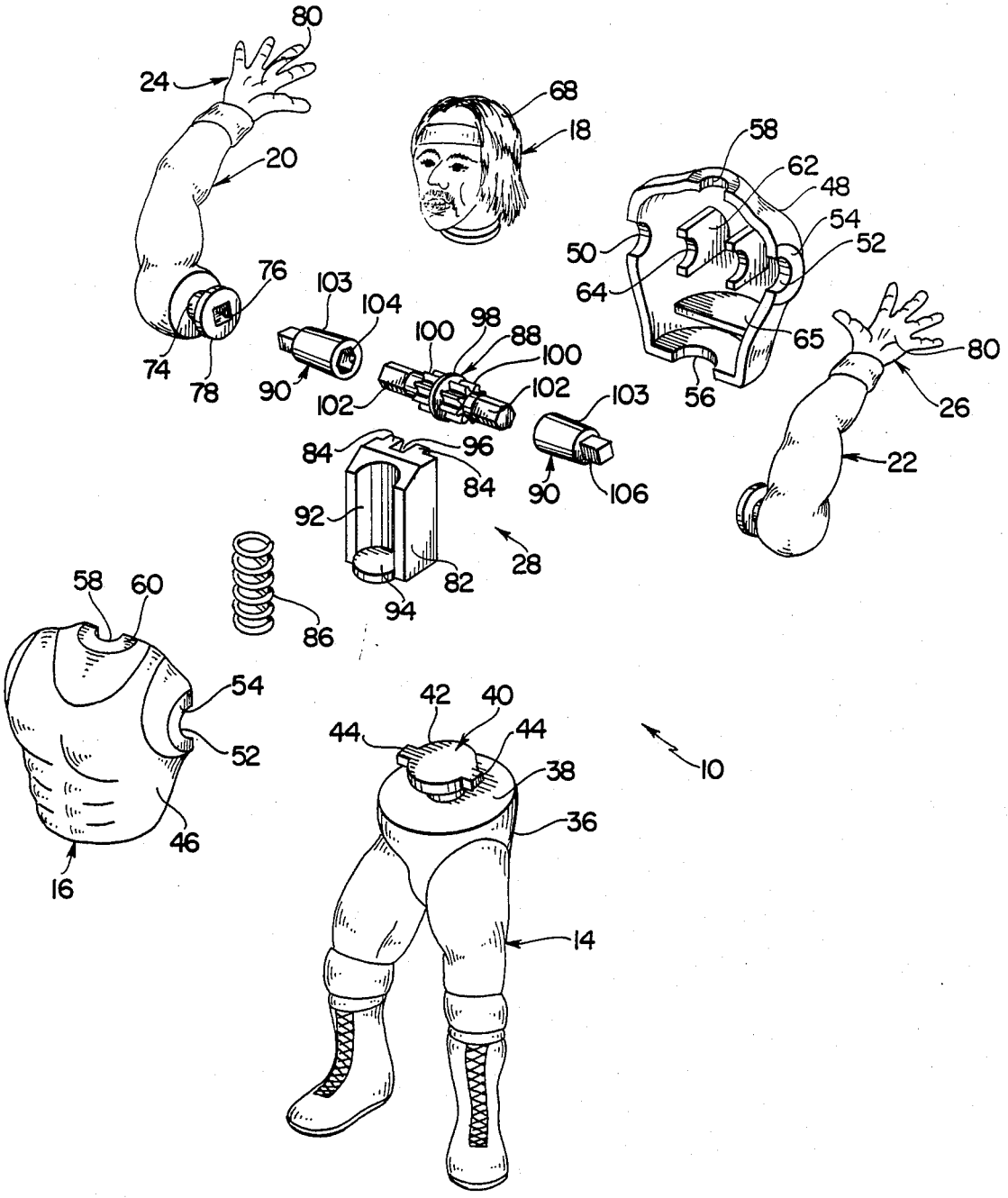
FIG. 4 is an exploded perspective view of the wrestler character figure.

The torso portion 16 includes front and rear shell portions 46 and 48, respectively, which are each preferably integrally molded from a plastic material. First and second arm sockets 50 and 52, respectively, are formed in the torso portion 16, so that the first and second arm sockets 50 and 52, respectively, are each formed partially in the front shell portion 46 and partially in the rear shell portion 48. Substantially flat mating surfaces 54 are formed around the sockets 50 and 52. A lower mounting socket 56 which is formed partially in each of the front and rear shell portions 46 and 48, respectively, is provided for mounting the torso portion 16 on the leg portion 14. In this connection, when the torso portion 16 is assembled on the leg portion 14, the torso portion 16 is rotatable by approximately 90 degrees in either direction, the extent of rotation being limited by the posts 44 which engage the inner walls of the shell portions 46 and 48 to prevent rotation beyond approximately 90 degrees in either direction. A head and neck portion mounting socket 58 is formed at the upper end of the torso portion 16, so that the socket 58 is partially defined by each of the front and rear shell portions 46 and 48, and a substantially flat face 60 is formed around the socket 58. A pair of biasing assembly mounts 62 extends forwardly in the rear shell portion 48, and a corresponding pair of mounts 63 (see FIGS. 2 and 3) extends rearwardly in the front shell portion 46, the mounts 62 and 63 terminating in rounded notches 64 which are substantially axially aligned with the arm portion mounting sockets 50 and 52. As illustrated in FIGS. 2 and 3, a horizontal stop 65 extends forwardly in the rear shell portion 48, and a horizontal biasing shelf 66 extends inwardly in the torso portion 16 from the front shell portion 46. A pair of spaced substantially parallel, vertical outer guide walls 67 (see FIGS. 2 and 3) extends rearwardly in the interior of the front shell portion 46, and a center guide wall **67*a* extends rearwardly by a reduced amount between the outer guide walls 67**.

The head and neck portion 18 includes a head section 68 and a downwardly projecting mounting post 70 having an enlarged terminal portion 72. The mounting post 70 is received in the socket 58, so that the head and neck portion 18 is rotatably secured to the torso portion 16 with the enlarged terminal end portion 72.

The first and second arm portions 20 and 22, respectively, are formed in the configurations of the right and left arms, respectively, of the character FIG. 10, and they include terminal mounting posts 74 having sockets 76 of substantially square cross section formed therein and enlarged terminal flange portions 78. The arm portions 20 and 22 are preferably molded from a suitable plastic material, and they are configured to resemble muscular human arms which are in substantially straight dispositions. The arm portions 20 and 22 are rotatably received in the sockets 50 and 52, respectively, in the torso portion 16, so that the arm portions 20 and 22 are rotatable between the substantially vertically upwardly extending first positions thereof illustrated in FIGS. 1 and 2 and the downwardly extending second positions thereof illustrated in FIG. 3.

The first and second hand portions 24 and 26, respectively, are preferably integrally formed on the first and second arm portions 20 and 22, respectively. The hand portions 24 and 26 include palms 80, and the hand portions 24 and 26 are attached to the arm portions 20 and 22, respectively, so that the hand portions 24 and 26 are disposed above the head and neck portion 18 in substantially horizontal dispositions, wherein the palms 80 thereof face upwardly when the arms 20 and 22 are in the upwardly extending first positions thereof. As a result, the hand portions 24 and 26 can be effectively utilized for supporting the opponent wrestler character FIG. 30 above the head and neck portion 18 when the first and second arm portions 20 and 22, respectively, are in the first positions thereof.

The biasing assembly 28 is operative for mechanically interconnecting the first and second arm portions 20 and 22 respectively, for movement together between the first and second positions thereof, and for biasing the first and second arm portions 20 and 22, respectively, toward the downwardly pivoted second positions thereof. The biasing assembly 28 includes an open spring housing 82 which is integrally formed with a pair of rack gears 84, a coil spring 86, a pinion gear assembly generally indicated at 88 and a pair of socket connectors 90. The spring housing 82 includes a rounded open channel 92 and a bottom wall element 94 which defines the lower end of the channel 92. As illustrated in FIGS. 2 and 3, the spring 86 and the spring housing 82 are mounted in the interior of the torso portion 16, so that the spring 86 is received in the channel 92 and captured between the bottom wall 94 and the shelf 66. Further, the spring housing 82 is received between the outer guide walls 67 and maintained in a predetermined rearwardly spaced relation by the center guide wall **67*a*. The rack gears 84 are formed on the rear side of the spring housing 82 and they are substantially vertically disposed as illustrated. The rack gears 84 cooperate to define a rearwardly opening channel or slot 96 therebetween. The pinion gear assembly 88 includes a circular central disc portion 98 which separates a pair of pinion gears 100 and a pair of hexagonal shafts 102 which extend outwardly from the pinion gears 100. The socket connectors 90 include substantially cylindrical main portions 103 having hexagonal sockets 104 formed therein, and substantially square shafts 106 project outwardly from the main portions 103. The socket connectors 90 are assembled with the pinion gear assembly 88, so that the shafts 102 are received in the sockets 104, and the cylindrical body portions 103 are received in the rounded notches in the mounts 62 and 63 which extend forwardly from the rear shell portion 48 and rearwardly in the front shell portion. The pinion gear assembly 88 is assembled with the rack gears 84, so that each of the pinion gears 100 intermeshes with one of the rack gears 84, and so that the disc 98 travels in the slot 96 between the rack gears 84. The shafts 106 are received in the substantially square sockets 76 in the mounting posts 74 of the first and second arm portions 20 and 22, respectively. Further, the biasing assembly 28 is assembled with the arm portions 20 and 22, respectively, so that the spring 86 is in a compressed disposition when the arm portions 20 and 22 are in the upwardly extending first positions thereof; and hence, the spring 86 is operative for rotationally biasing the pinion gear assembly 88 through the rack gears 84 in order to bias the arm portions 20 and 22 toward the downwardly extending second positions thereof. Further, as illustrated in FIG. 3, when the arm portions 20 and 22 are in the downwardly extending second positions thereof, the lower end of the spring housing 82 engages the stop 65 to limit the extent of downward movement possible for the arm portions 20 and 22, respectively. On the other hand, when the arm portions 20 and 22, respectively, are in the upwardly extending first positions thereof, the limit of upward movement is determined by the spring 86** which is essentially in a fully compressed disposition.

The opponent character FIG. 30 preferably comprises a simulated wrestling character figure which is preferably of substantially the same dimension as the wrestler character FIG. 10. Further, the opponent character FIG. 30 is preferably normally positioned in a substantially straight disposition, as illustrated in FIG. 1, so that the opponent character FIG. 30 can be balanced on the hand portions 24 and 26 when the arm portions 20 and 22 are in the upwardly extending first positions thereof.

Accordingly, for use and operation of the wrestler character FIG. 10 the arm portions 20 and 22 are manually pivoted upwardly and manually held in the first upwardly extending positions thereof as illustrated in FIGS. 1 and 2. Thereafter, the opponent character FIG. 30 is placed on the hand portions 24 and 26 so that the opponent character FIG. 30 is positioned above the head and neck portion 18. The arm portions 20 and 22 are then released, so that they are pivoted downwardly by the biasing mechanism 28. As the arm portions 20 and 22 are pivoted downwardly, the opponent character FIG. 30 is thrown to the floor to simulate an overhead body slam maneuver.

It is seen therefore that the instant invention provides an effective and amusing action figure character. As illustrated, the wrestling character FIG. 10 is adapted to perform a simulated overhead body slam type professional wrestling maneuver. Accordingly, the wrestling character FIG. 10 can be effectively utilized in a wrestling theme play environment for simulating the activities of a professional wrestling character. As a result, the wrestler character FIG. 10 has a relatively high play value, and it represents a significant advancement in the toy art.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A wrestler character figure comprising:

(a) a main body member receivable in free standing relation on a supporting surface, said main body member including a leg portion, a torso portion supported on said leg portion, and a head and neck portion supported on said torso portion;

(b) a first arm portion pivotally mounted on said torso portion for movement between an upwardly extending first position and a downwardly extending second position;

(c) a first hand portion on said first arm portion;

(d) a second arm portion pivotally mounted on said torso portion for movement between an upwardly extending first position and a downwardly extending second position;

(e) a second hand portion on said second arm portion; and (f) means biasing said first and second arm portions toward the second positions thereof, said biasing means connecting said first and second arm portions together for movement together between the respective first and second positions thereof;

(g) said first and second arm portions pivoting forwardly and downwardly for movement from the first positions thereof to the second positions thereof, said first and second arm portions and said first and second hand portions being positioned so that said first and second arm portions extend substantially directly vertically upwardly and said first and second hand portions are in substantially horizontally disposed upwardly facing positions when said first and second arm portions are in the first positions thereof and so that said first and second hand portions face at least partially downwardly when said first and second arm portions are in the second positions thereof to enable said first and second hand portions to be utilized for supporting an opponent character figure above said neck and head portion when said first and second arm portions are in the first positions thereof and for throwing said opponent character figure directly downwardly toward said supporting surfaces as said first and second arm portions are moved to the second positions thereof.

* * * * *